US010464232B2

(12) United States Patent
Nakamura

(10) Patent No.: US 10,464,232 B2
(45) Date of Patent: Nov. 5, 2019

(54) SHEET MANUFACTURING APPARATUS AND SHEET MANUFACTURING METHOD

(71) Applicant: Seiko Epson Corporation, Tokyo (JP)

(72) Inventor: Masahide Nakamura, Matsumoto (JP)

(73) Assignee: Seiko Epson Corporation (JP)

( * ) Notice: Subject to any disclaimer, the term of this patent is extended or adjusted under 35 U.S.C. 154(b) by 181 days.

(21) Appl. No.: 15/546,130

(22) PCT Filed: Jan. 28, 2016

(86) PCT No.: PCT/JP2016/000444

§ 371 (c)(1),
(2) Date: Jul. 25, 2017

(87) PCT Pub. No.: WO2016/139885

PCT Pub. Date: Sep. 9, 2016

(65) Prior Publication Data

US 2018/0021976 A1 Jan. 25, 2018

(30) Foreign Application Priority Data

Mar. 4, 2015 (JP) ..... 2015-042113

(51) Int. Cl.

| | |
|---|---|
| ***D04H 1/732*** | (2012.01) |
| ***D21B 1/06*** | (2006.01) |
| ***D21B 1/02*** | (2006.01) |
| ***B27N 3/04*** | (2006.01) |

(52) U.S. Cl.

CPC ..... *B27N 3/04* (2013.01); *D04H 1/732* (2013.01); *D21B 1/028* (2013.01); *D21B 1/06* (2013.01)

(58) Field of Classification Search

None

See application file for complete search history.

(56) References Cited

U.S. PATENT DOCUMENTS

| | | | |
|---|---|---|---|
| 8,882,965 | B2 | 11/2014 | Yamagami et al. |
| 2016/0053435 | A1 | 2/2016 | Oguchi et al. |

(Continued)

FOREIGN PATENT DOCUMENTS

| | | | |
|---|---|---|---|
| JP | 02-041202 | A | 2/1990 |
| JP | 04-504233 | A | 7/1992 |
| JP | 2004-339653 | A | 12/2004 |

(Continued)

OTHER PUBLICATIONS

Extended European Search Report for Patent Application No. EP 16758586.8 dated Jun. 25, 2018 (6 pages).

*Primary Examiner* — Mary Lynn F Theisen

(74) *Attorney, Agent, or Firm* — Harness, Dickey & Pierce, P.L.C.

(57) ABSTRACT

A sheet manufacturing apparatus capable of suppressing adhesion of defibrated material to the inside of the apparatus is provided. A sheet manufacturing apparatus has a defibrating unit that defibrates into defibrated material feedstock containing fiber; mesh that captures at least part of the defibrated material conveyed from the defibrating unit by gas, and passes the gas; an opening to which the defibrated material captured by the mesh, and gas of a different state than the gas from the defibrating unit, are introduced; and a sheet forming unit that forms a sheet using the defibrated material introduced from the opening.

8 Claims, 3 Drawing Sheets

(56) References Cited

U.S. PATENT DOCUMENTS

| | | | | |
|---|---|---|---|---|
| 2016/0229129 | A1* | 8/2016 | Ueno | B29C 70/06 |
| 2016/0230338 | A1 | 8/2016 | Nakamura et al. | |

FOREIGN PATENT DOCUMENTS

| | | | |
|---|---|---|---|
| JP | 2012-144819 | A | 8/2012 |
| JP | 2014-208446 | A | 11/2014 |
| WO | WO-89-05716 | A1 | 6/1989 |
| WO | WO-00-04232 | A1 | 1/2000 |
| WO | WO-2015-049817 | A1 | 4/2015 |

* cited by examiner

SHEET MANUFACTURING APPARATUS AND SHEET MANUFACTURING METHOD

BACKGROUND

Technical Field

The present invention relates to a sheet manufacturing apparatus and a sheet manufacturing method.

Background

Sheet manufacturing apparatuses conventionally use a wet process in which feedstock containing fiber is soaked in water, defibrated by primarily a mechanical action, and then screened. Such wet-process sheet manufacturing apparatuses require a large amount of water and are large. Maintenance of the water treatment facilities is also time-consuming, and energy consumption by the drying process is great.

As a result, a dry process sheet manufacturing apparatus that uses as little water as possible has been proposed to reduce device size and energy consumption. For example, JP-A-2012-144819 describes defibrating paper shreds into fibers in a dry defibrator, deinking the fiber in a cyclone, passing the deinked fiber through a foraminous screen on the surface of a forming drum and laying the fiber on a mesh belt to make paper.

In the sheet manufacturing apparatus described in JP-A-2012-144819, however, the defibrator may heat up to a high temperature depending on the operating time of the defibrator, and air that has passed through the defibrator reaches a high temperature with low moisture content. Because this air then passes through a cyclone and flows into the forming drum (laying unit), the defibrated material (defibrated fiber) conveyed by the air stream from the defibrator to the laying unit is dry. The defibrated material may therefore become charged and adhere to the inside of the laying unit.

When defibrated material adheres to the inside of the defibrator, making sheets with the desired grammage may not be possible; and when the adhesion strength of the defibrated material is high, the path of the defibrated material inside the sheet manufacturing apparatus may become clogged and making sheets may not be possible. The defibrated material adhering inside the defibrator may also form clumps, and the clumped defibrated material may be laid on the mesh belt, lowering the quality of the sheet.

An objective of some aspects of the invention is to provide a sheet manufacturing apparatus capable of suppressing defibrated material from adhering to the inside of the apparatus. An objective of some aspects of the invention is to provide a sheet manufacturing method capable of suppressing defibrated material from adhering to the inside of the apparatus.

SUMMARY

The present invention is directed to solving at least part of the foregoing problems, and can be achieved by the embodiments or examples described below.

A first aspect of a sheet manufacturing apparatus according to the invention includes:

a defibrating unit that defibrates feedstock containing fiber into defibrated material;

mesh that captures at least part of the defibrated material conveyed from the defibrating unit by a gas, and passes the gas;

an opening to which the defibrated material captured by the mesh, and gas of a different state than the gas from the defibrating unit, are introduced; and a sheet forming unit that forms a sheet using the defibrated material introduced from the opening.

By removing hot, dry gas produced by heat generated in the defibrating unit from the defibrated material, and using gas in a different state than the removed gas, this sheet manufacturing apparatus can convey the defibrated material to the air-laying unit while suppressing drying the defibrated material. The sheet manufacturing apparatus can therefore suppress drying, charging, and adhesion of the defibrated material to the inside of the apparatus.

A sheet manufacturing apparatus according to the invention may also have a discharge vent from which gas passing through the mesh is discharged.

This sheet manufacturing apparatus can more reliably discharge gas from the defibrating unit to the outside of the apparatus.

In a sheet manufacturing apparatus according to the invention, the temperature of gas introduced from the opening is lower than the temperature of gas from the defibrating unit.

The sheet manufacturing apparatus can therefore more reliably suppress drying and charging of defibrated material introduced from the opening.

A sheet manufacturing apparatus according to the invention may also have a wetting unit that wets the defibrated material captured by the mesh.

This sheet manufacturing apparatus can adjust the moisture content of the defibrated material captured by the mesh, and can more reliably suppress drying and charging of defibrated material captured by the mesh.

In a sheet manufacturing apparatus according to the invention, the wetting unit humidifies gas introduced from the opening.

This sheet manufacturing apparatus can adjust the moisture content of the defibrated material by the wetting unit humidifying the gas introduced from the opening.

In a sheet manufacturing apparatus according to the invention, the mesh is a mesh belt that is driven rotationally.

This sheet manufacturing apparatus can introduce use the mesh to introduce defibrated material to the opening.

A sheet manufacturing apparatus according to the invention may also have a suction unit that suctions gas from the defibrating unit from the opposite side of the mesh as the surface that captures the defibrated material.

This sheet manufacturing apparatus can more reliably remove coloring agents and other additives contained in the defibrated material.

A sheet manufacturing apparatus according to the invention may also have:

a separator that separates the defibrated material defibrated by the defibrating unit; and a laying unit that detangles and lays the defibrated material introduced from the opening;

the mesh capturing at least part of the defibrated material separated by the separator; and the sheet forming unit forming the sheet using the defibrated material detangled by the laying unit.

This sheet manufacturing apparatus can return to the defibrating unit large fibers, undefibrated shreds, and clumps (material that did not pass through the screen of the separator).

Another aspect of the invention is a sheet manufacturing method including:

defibrating, by a defibrating unit, feedstock containing fiber into defibrated material;

separating from the defibrated material at least part of gas from the defibrating unit, and introducing to an opening the defibrated material and gas of a different state than the gas from the defibrating unit; and forming a sheet using the defibrated material introduced from the opening.

This sheet manufacturing method enables suppressing defibrated material from adhering to the inside of the apparatus.

DETAILED DESCRIPTION

Preferred embodiments of the invention are described below with reference to the accompanying figures. Note that the embodiments described below do not unduly limit the scope of the invention described in the accompanying claims. All configurations described below are also not necessarily essential elements of the invention.

1. Sheet Manufacturing Apparatus 1.1. Configuration

Figure 1:
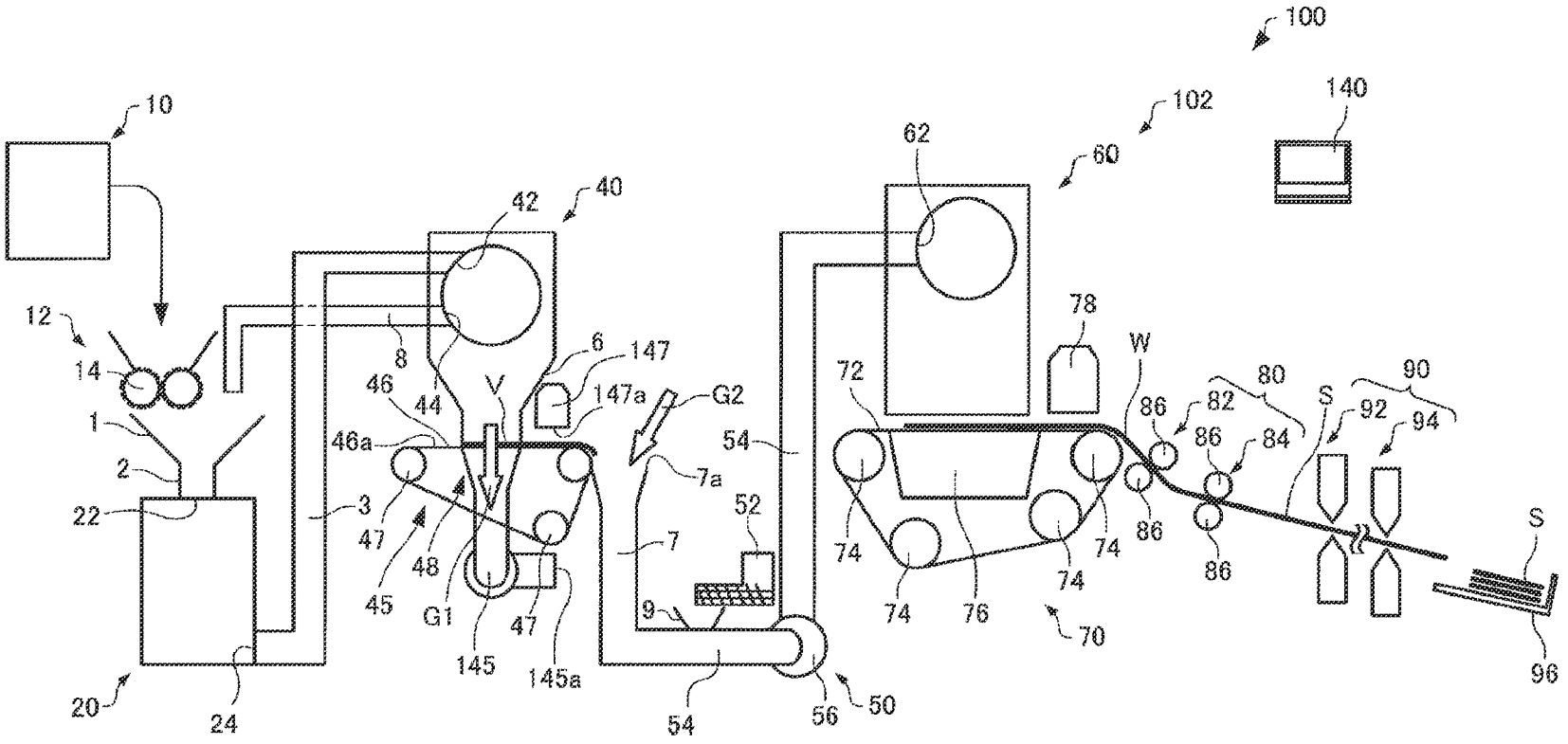
FIG. 1 illustrates a sheet manufacturing apparatus according to an embodiment of the invention.

A sheet manufacturing apparatus according to this embodiment is described below with reference to the accompanying figures. FIG. 1 schematically illustrates a sheet manufacturing apparatus 100 according to this embodiment.

As shown in FIG. 1, the sheet manufacturing apparatus 100 has a supply unit 10, manufacturing unit 102, and control unit 140. The manufacturing unit 102 manufactures sheets. The manufacturing unit 102 includes a shredder 12, defibrating unit 20, separator 40, first web forming unit 45, mixing unit 50, air-laying unit 60, second web forming unit 70, sheet forming unit 80, and cutting unit 90.

The supply unit 10 supplies feedstock to the shredder 12. The supply unit 10 is, for example, an automatic loader for continuously supplying feedstock material to the shredder 12. The feedstock supplied by the supply unit 10 includes fiber from recovered paper or pulp sheets, for example.

The shredder 12 cuts feedstock supplied by the supply unit 10 into shreds in air. The shreds in this example are pieces a few centimeters in size. In the example in the figure, the shredder 12 has shredder blades 14, and shreds the supplied feedstock by the shredder blades 14. In this example, a paper shredder is used as the shredder 12. The feedstock shredded by the shredder 12 is received into a hopper 1 and carried (conveyed) to the defibrating unit 20 through a conduit 2.

The defibrating unit 20 defibrates the feedstock shredded by the shredder 12. Defibrate as used here is a process of separating feedstock (material to be defibrated) comprising interlocked fibers into individual detangled fibers. The defibrating unit 20 also functions to separate particulate such as resin, ink, toner, and sizing agents in the feedstock from the fibers.

Material that has passed through the defibrating unit 20 is referred to as defibrated material. In addition to untangled fibers, the defibrated material may also contain resin particles (resin used to bind multiple fibers together), coloring agents such as ink and toner, sizing agents, paper strengthening agents, and other additives that are separated from the fibers when the fibers are detangled. The shape of the detangled defibrated material is a string or ribbon. The detangled, defibrated material may be separated from (not interlocked with) other detangled fibers, or may be in lumps interlocked with other detangled defibrated material (in so-called fiber clumps).

The defibrating unit 20 defibrates in a dry process in ambient air (air). More specifically, an impeller mill is used as the defibrating unit 20. The defibrating unit 20 can also create an air flow that sucks in the feedstock and then discharges the defibrated material. As a result, the defibrating unit 20 can suction the feedstock with the air flow from the inlet 22, defibrate, and then convey the defibrated material to the exit 24 using the air flow produced by the defibrating unit 20. The defibrated material that passes the defibrating unit 20 is conveyed through a conduit 3 to the separator 40.

The separator 40 selects fibers by length from the defibrated material that was defibrated by the defibrating unit 20 and was introduced from the inlet 42. A sieve (sifter) is used as the separator 40. The separator 40 has mesh (filter, screen), and can separate fiber or particles smaller than the size of the openings in the mesh (that pass through the mesh, first selected material) from fiber, undefibrated shreds, and clumps that are larger than the openings in the mesh (that do not pass through the mesh, second selected material). For example, the first selected material is received in a hopper 6 and then conveyed through a conduit 7 to the mixing unit 50. The second selected material is returned from the exit 44 through another conduit 8 to the defibrating unit 20. More specifically, the separator 40 is a cylindrical sieve that can be rotated by a motor. The mesh of the separator 40 may be a metal screen, expanded metal made by expanding a metal sheet with slits formed therein, or punched metal having holes formed by a press in a metal sheet.

The first web forming unit 45 conveys the first selected material from the separator 40 to the mixing unit 50. The first web forming unit 45 includes, for example, a mesh belt 46, tension rollers 47, and a suction unit (suction mechanism) 48.

The suction unit 48 suctions the first selected material that passes through the openings (mesh openings) in the separator 40 and was dispersed in air onto the mesh belt 46. The first selected material accumulates on the moving mesh belt 46, forming a web V. The basic configuration of the mesh belt 46, tension rollers 47, and suction unit 48 are the same as the mesh belt 72, tension rollers 74, and suction mechanism 76 of the second web forming unit 70 described below.

The web V is a soft, fluffy web containing a lot of air as a result of passing through the separator 40 and first web forming unit 45. The web V formed on the mesh belt 46 is fed into a conduit 7 and conveyed to the mixing unit 50.

The mixing unit 50 mixes an additive containing resin with the first selected material (the first selected material conveyed by the first web forming unit 45) that passes the separator 40. The mixing unit 50 has an additive supply unit 52 that supplies additive, a conduit 54 for conveying the selected material and additive, and a blower 56. In the example in the figure, the additive is supplied from the additive supply unit 52 through a hopper 9 to a conduit 54. Conduit 54 communicates with conduit 7.

The mixing unit 50 uses the blower 56 to produce an air flow, and can convey while mixing the selected material and additives in the conduit 54. Note that the mechanism for mixing the first selected material and additive is not specifically limited, and may mix by means of blades turning at high speed, or may use rotation of the container like a V blender.

A screw feeder such as shown in FIG. 1, or a disc feeder not shown, for example, may be used as the additive supply unit 52. The additive supplied from the additive supply unit 52 contains resin for binding multiple fibers together. The multiple fibers are not bound when the resin is supplied. The resin melts and binds multiple fibers when passing the sheet forming unit 80.

The resin supplied from the additive supply unit 52 is a thermoplastic resin or thermoset resin, such as as resin, ABS resin, polypropylene, polyethylene, polyvinyl chloride, polystyrene, acrylic resin, polyester resin, polyethylene terephthalate, polyethylene ether, polyphenylene ether, polybutylene terephthalate, nylon, polyimide, polycarbonate, polyacetal, polyphenylene sulfide, and polyether ether ketone. These resins may be used individually or in a desirable combination. The additive supplied from the additive supply unit 52 may be fibrous or powder.

Depending on the type of sheet being manufactured, the additive supplied from the additive supply unit 52 may also include a coloring agent for coloring the fiber, an anti-blocking agent to prevent fiber agglomeration, or a flame retardant for making the fiber difficult to burn, in addition to resin for binding fibers. The mixture (a mixture of first selected material and additive) that passes the mixing unit 50 is conveyed through a conduit 54 to the air-laying unit 60.

The mixture that passes the mixing unit 50 is introduced from the inlet 62 to the air-laying unit 60, which detangles and disperses the tangled defibrated material (fiber) in air while the mixture precipitates. When the resin in the additive supplied from the additive supply unit 52 is fibrous, the air-laying unit 60 also detangles interlocked resin fibers. As a result, the air-laying unit 60 can lay the mixture uniformly in the second web forming unit 70.

A cylindrical sieve that turns is used as the air-laying unit 60. The air-laying unit 60 has mesh, and causes fiber and particles smaller than the size of the mesh (that pass through the mesh) and contained in the mixture that passes the mixing unit 50 to precipitate. The configuration of the air-laying unit 60 is the same as the configuration of the separator 40 in this example.

Note that the sieve of the air-laying unit 60 may be configured without functionality for selecting specific material. More specifically, the "sieve" used as the air-laying unit 60 means a device having mesh, and the air-laying unit 60 may cause all of the mixture introduced to the air-laying unit 60 to precipitate.

The second web forming unit 70 lays the precipitate that passes through the air-laying unit 60 into a web W. The web forming unit 70 includes, for example, a mesh belt 72, tension rollers 74, and a suction mechanism 76.

The mesh belt 72 is moving while precipitate that has passed through the holes (mesh) of the air-laying unit 60 accumulates thereon. The mesh belt 72 is tensioned by the tension rollers 74, and is configured so that air passes through but it is difficult for the precipitate to pass through. The mesh belt 72 moves when the tension rollers 74 turn. A web W is formed on the mesh belt 72 as a result of the mixture that passes the air-laying unit 60 precipitating continuously while the mesh belt 72 moves continuously. The mesh belt 72 may be metal, plastic, cloth, or nonwoven cloth.

The suction mechanism 76 is disposed below the mesh belt 72 (on the opposite side as the air-laying unit 60). The suction mechanism 76 produces a downward flow of air (air flow directed from the air-laying unit 60 to the mesh belt 72). The mixture distributed in air by the air-laying unit 60 can be pulled onto the mesh belt 72 by the suction mechanism 76. As a result, the discharge rate from the air-laying unit 60 can be increased. A downward air flow can also be created in the descent path of the mixture, and interlocking of defibrated material and additive during descent can be prevented, by the suction mechanism 76.

A soft, fluffy web W containing much air is formed by material passing through the air-laying unit 60 and second web forming unit 70 (web forming process) as described above. The web W laid on the mesh belt 72 is then conveyed to the sheet forming unit 80.

Note that a moisture content adjustment unit 78 for adjusting the moisture content of the web W is disposed in the example shown in the figure. The moisture content adjustment unit 78 adds water or water vapor to the web W to adjust the ratio of water to the web W.

The sheet forming unit 80 applies heat and pressure to the web W laid on the mesh belt 72, forming a sheet S. By applying heat to the mixture of defibrated material and additive contained in the web W, the sheet forming unit 80 can bind fibers in the mixture together through the additive (resin).

A heat roller (heating roller), hot press molding machine, hot plate, hot air blower, infrared heater, or flash fuser, for example, may be used in the sheet forming unit 80. In the example shown in the figure, the sheet forming unit 80 has a first binding unit 82 and a second binding unit 84, and the binding units 82, 84 each have a pair of heat rollers 86. By configuring the binding units 82, 84 with heat rollers 86, a sheet S can be formed while continuously conveying the web W, unlike when the binding units 82, 84 are configured with a flat press (flat press machine). Note that the number of heat rollers 86 is not specifically limited.

The cutting unit 90 cuts the sheet S formed by the sheet forming unit 80. In the example in the figure, the cutting unit 90 has a first cutter 92 that cuts the sheet S crosswise to the conveyance direction of the sheet S, and a second cutter 94 that cuts the sheet S parallel to the conveyance direction. The second cutter 94 cuts the sheet S after passing through the first cutter 92, for example.

Cut sheets S of a specific size are formed by the process described above. The cut sheets S are then discharged to the discharge unit 96.

1.2. First Web Forming Unit

The first web forming unit 45 is described next with reference to FIG. 1.

The mesh belt 46 of the first web forming unit 45 is mesh sized to capture at least part of the defibrated material (defibrated material selected by the separator 40) that is conveyed from the defibrating unit 20 by gas G1, and allow the gas G1 from the defibrating unit 20 to pass through. The mesh belt 46 is driven rotationally by the tension rollers 47. The suction unit 48 of the first web forming unit 45 suctions gas G1 from the opposite side of the mesh belt 46 as the surface 46*a* that captures the defibrated material. For example, by driving the suction unit 48 and defibrating unit 20, an air flow is produced from the defibrating unit 20 to the first web forming unit 45, and gas G1 and defibrated material are introduced to the first web forming unit 45.

The first web forming unit 45 has a conduit 145 that communicates with the hopper 6. The conduit 145 has an outlet 145*a* from which gas G1 that passes the mesh belt 46 is vented. The gas G1 is thus discharged upstream from the air-laying unit 60 (in this sheet manufacturing apparatus 100, on the defibrating unit 20 side of the path of the defibrated material from the defibrating unit 20 to the discharge unit 96).

By appropriately setting the size of the mesh in the mesh belt 46, for example, the first web forming unit 45 can discharge relatively small (short) fiber, resin particles, coloring agents, and other additives contained in the defibrated material together with the gas G1 from the outlet 145*a*. This increases the percentage of relatively large (long) fiber in the defibrated material.

The first web forming unit 45 also has a wetting unit 147 that adds moisture to the defibrated material captured by the mesh belt 46. The wetting unit 147 adds water or water vapor directly to the web V (defibrated material) laid on the mesh belt 46. In this example, the outlet 147*a* from which the wetting unit 147 discharges water faces the mesh belt 46. The basic configuration of the wetting unit 147 is the same as the moisture content adjustment unit 78 described above.

The conduit 7 to which the web V is introduced has an opening 7*a*. The defibrated material (web V) captured by the mesh belt 46, and gas G2 different from gas G1, are introduced to the opening 7*a*. In the example in the figure, the opening 7*a* is adjacent to the first web forming unit 45. The gas G2 is introduced to the opening 7*a* by driving the blower 56 of the mixing unit 50.

The temperature of the gas G2 introduced from the opening 7*a* is lower than the temperature of gas G1. This is because gas G1 is heated by heat produced in the defibrating unit 20, and becomes hot. For example, the temperature of gas G1 may range from 10° C. to 80° C., and the temperature of gas G2 may range from 10° C. to 40° C. Gases G1 and G2 in this example are ambient air (air). Gas G2 may be introduced from outside the sheet manufacturing apparatus 100 or inside, but because air inside the sheet manufacturing apparatus 100 is warmed by heat produced when driving the apparatus, gas G2 is preferably introduced from outside. Note that gas G1 and gas G2 are substantially the same temperature immediately after the sheet manufacturing apparatus 100 starts operating, but the temperature of gas G1 rises to above the temperature of gas G2 as heat is produced by the continued operation of the defibrating unit 20.

As described above, the first web forming unit 45 separates and discharges from the outlet 145*a* at least part of the gas G1 from the defibrating unit 20, and introduces the defibrated material to the opening 7*a*. The mixing unit 50 introduces gas G2 from the opening 7*a*, and mixes and conveys the defibrated material with the gas G2 to the air-laying unit 60. The air-laying unit 60 then detangles and lays the defibrated material introduced from the opening 7*a* on the mesh belt 72, and the sheet forming unit 80 forms a sheet S using the defibrated material detangled by the air-laying unit 60 (using the defibrated material introduced from the opening 7*a*). The defibrating unit 20, first web forming unit 45, and mixing unit 50, for example, may be controlled by the control unit 140. The control unit 140 may be a personal computer.

Characteristics of the sheet manufacturing apparatus 100 are described below.

The sheet manufacturing apparatus 100 has mesh 46 that captures defibrated material conveyed from the defibrating unit 20 by gas G1, and allows the gas G1 to pass through; and an opening 7*a* to which are introduced the defibrated material captured by the mesh 46 and a gas G2 in a different condition than the gas G1. As a result, the sheet manufacturing apparatus 100 can separate the high temperature, dry (high temperature, low humidity) gas G1 that was heated in the defibrating unit 20 from the defibrated material, and using gas G2 that is different from gas G1, can suppress drying the defibrated material and convey the defibrated material to the air-laying unit 60. The sheet manufacturing apparatus 100 can therefore suppress drying, charging, and adhering of the defibrated material to the inside of the apparatus. As a result, the sheet manufacturing apparatus 100 can make sheets S of the desired grammage.

More particularly, when defibrated material adheres to the inside of the air-laying unit, the adhering defibrated material may at some time be deposited at once on the mesh belt 72, significantly changing the thickness of the web W and preventing making sheets S of a desired grammage. Because adhesion of defibrated material to the inside the air-laying unit directly affects the grammage of the sheet S, preventing the defibrated material from adhering to the inside of the air-laying unit 60 is particularly desirable in order to make sheets S of a desired grammage.

Furthermore, because the sheet manufacturing apparatus 100 can suppress drying, charging, and adhesion of the defibrated material inside the equipment, the sheet manufacturing apparatus 100 can also suppress defibrated material clinging to the inside of the device from obstructing the path of defibrated material inside the sheet manufacturing apparatus. Clumping of defibrated material sticking to the inside the air-laying unit, clumps of defibrated material then being laid on the mesh belt, and the quality of the sheet dropping, can also be suppressed.

Furthermore, when paper pulp or other feedstock containing fiber that varies in stiffness depending on the amount of water is used, fibers may become rigid as they dry, making it difficult to increase the density of the sheet S when calendering the sheet in the sheet forming unit. As a result, the tensile strength and bending strength of the sheet may drop. The sheet manufacturing apparatus 100 solves this problem introducing the defibrated material captured by the mesh 46 to the opening 7*a* with gas G2 that is different from gas G1.

The first web forming unit 45 of the sheet manufacturing apparatus 100 in this example can also remove coloring agents and other additives contained in the defibrated material. More specifically, the first web forming unit 45 can deink the defibrated material. There is therefore no need for a cyclone or other classifier, and the cost and size of the sheet manufacturing apparatus 100 can be reduced accordingly.

The sheet manufacturing apparatus 100 has an outlet 145*a* for discharging gas G1 that passed through the mesh 46. As a result, the sheet manufacturing apparatus 100 can more reliably discharge the gas G1 from the apparatus.

The temperature of the gas G2 introduced from the opening 7*a* in the sheet manufacturing apparatus 100 is lower than the temperature of the gas G1 from the defibrating unit 20. As a result, the sheet manufacturing apparatus 100 can more dependably prevent drying and charging the defibrated material introduced from the opening 7*a*.

The sheet manufacturing apparatus 100 has a wetting unit 147 that adds moisture to the defibrated material captured by the mesh 46. As a result, the sheet manufacturing apparatus 100 can adjust the moisture content of the defibrated material captured by the mesh 46, and can more dependably prevent drying and charging the defibrated material captured by the mesh 46.

Note that when water is added to the feedstock shredded by the shredder and conveyed to the defibrator, the relative humidity of the gas G1 is reduced by the heat produced in the defibrator, and the amount of water added must be increased to achieve defibrated material with the desired moisture content. This may increase the cost and increase the size of the apparatus. The sheet manufacturing apparatus 100 in this example avoids this problem by adding moisture to the defibrated material captured by the mesh 46.

The mesh 46 of the sheet manufacturing apparatus 100 is a mesh belt that is driven rotationally. As a result, the sheet manufacturing apparatus 100 can use the mesh 46 to introduce the defibrated material to the opening 7*a*.

The sheet manufacturing apparatus 100 has a suction unit 48 that suctions the gas G1 from the back side of the surface 46*a* of the mesh 46 that captures the defibrated material. As a result, the sheet manufacturing apparatus 100 can more reliably remove coloring agents and other additives contained in the defibrated material.

The sheet manufacturing apparatus 100 has a separator 40 that selects defibrated material defibrated by the defibrating unit 20. As a result, the sheet manufacturing apparatus 100 can return large fibers, undefibrated shreds, and clumps (material that did not pass through the screen of the separator 40) to the defibrating unit 20.

A sheet manufacturing method using the sheet manufacturing apparatus 100 separates at least part of the gas G1 from the defibrating unit 20 from the defibrated material, and introduces the defibrated material and gas G2 in a different state than the gas G1 to the opening 7*a*. As a result, adhesion of the defibrated material to the inside of the device can be suppressed.

2. Variations of the Sheet Manufacturing Apparatus 2.1. Variation 1

Figure 2:
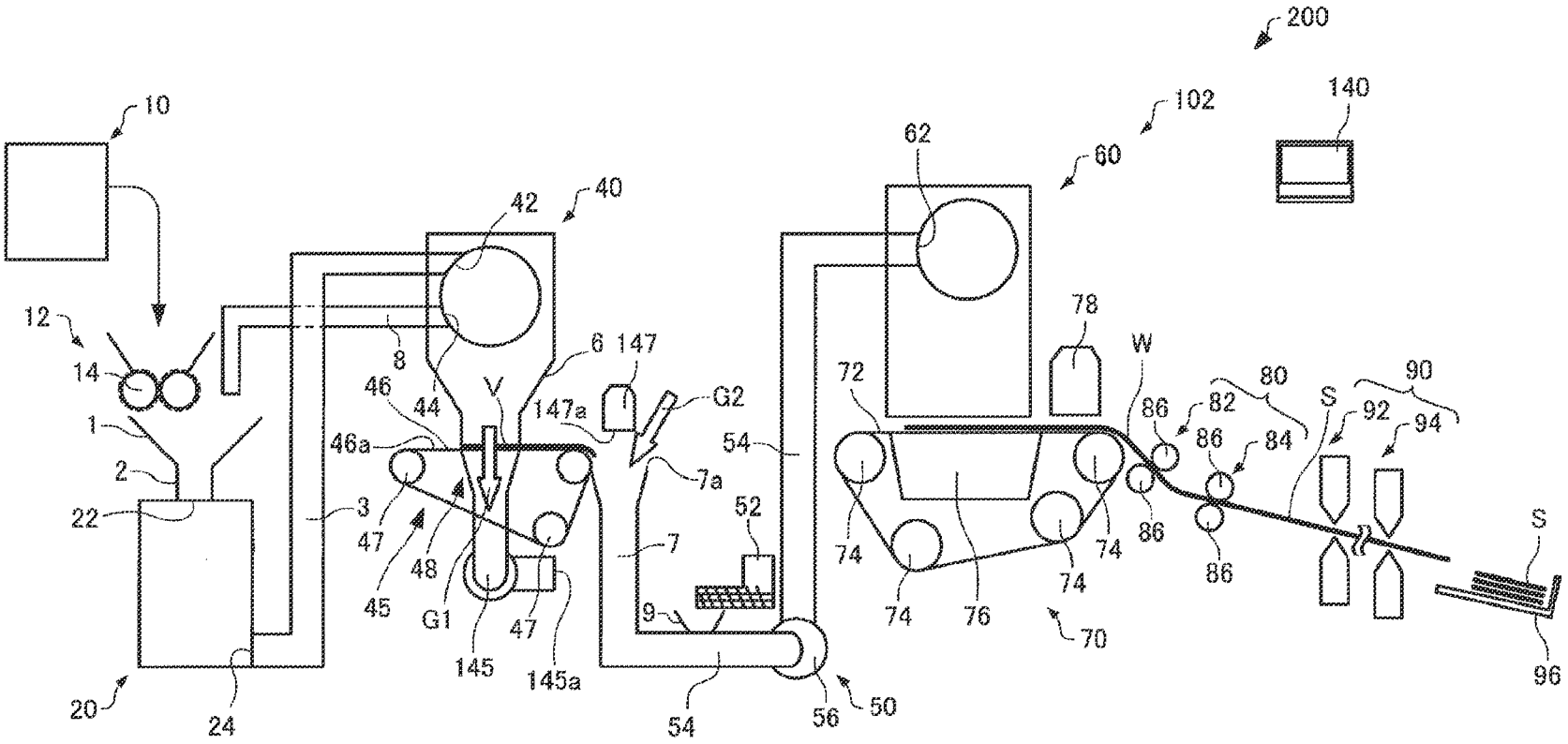
FIG. 2 illustrates a sheet manufacturing apparatus according to a first variation of the foregoing embodiment of the invention.

A sheet manufacturing apparatus according to a first variation of the foregoing embodiment is described next with reference to the figures. FIG. 2 illustrates a sheet manufacturing apparatus 200 according to a first variation of the foregoing embodiment of the invention. Note that parts of the sheet manufacturing apparatus 200 according to this first variation of the foregoing embodiment having the same function as parts of the sheet manufacturing apparatus 100 according to the embodiment described above are identified by like reference numerals, and further description thereof is omitted below.

As shown in FIG. 1, the outlet 147*a* of the wetting unit 147 in the sheet manufacturing apparatus 100 described above is disposed opposite the mesh belt 46 (above the mesh belt 46).

As shown in FIG. 2, the outlet 147*a* of the wetting unit 147 in this sheet manufacturing apparatus 200 is disposed opposite the opening 7*a* (disposed above the opening 7*a*). The wetting unit 147 humidifies the gas G2 introduced from the opening 7*a*. As a result, the defibrated material can be moistened.

Note that the location of the wetting unit 147 is not specifically limited insofar as water can be added to the defibrated material before the defibrated material is introduced to the air-laying unit 60, and the wetting unit 147 may be disposed inside the conduit 54, for example.

The sheet manufacturing apparatus 200 can adjust the moisture content of the defibrated material by the wetting unit 147 humidifying the gas G2 introduced from the opening 7*a*.

2.2. Variation 2

Figure 3:
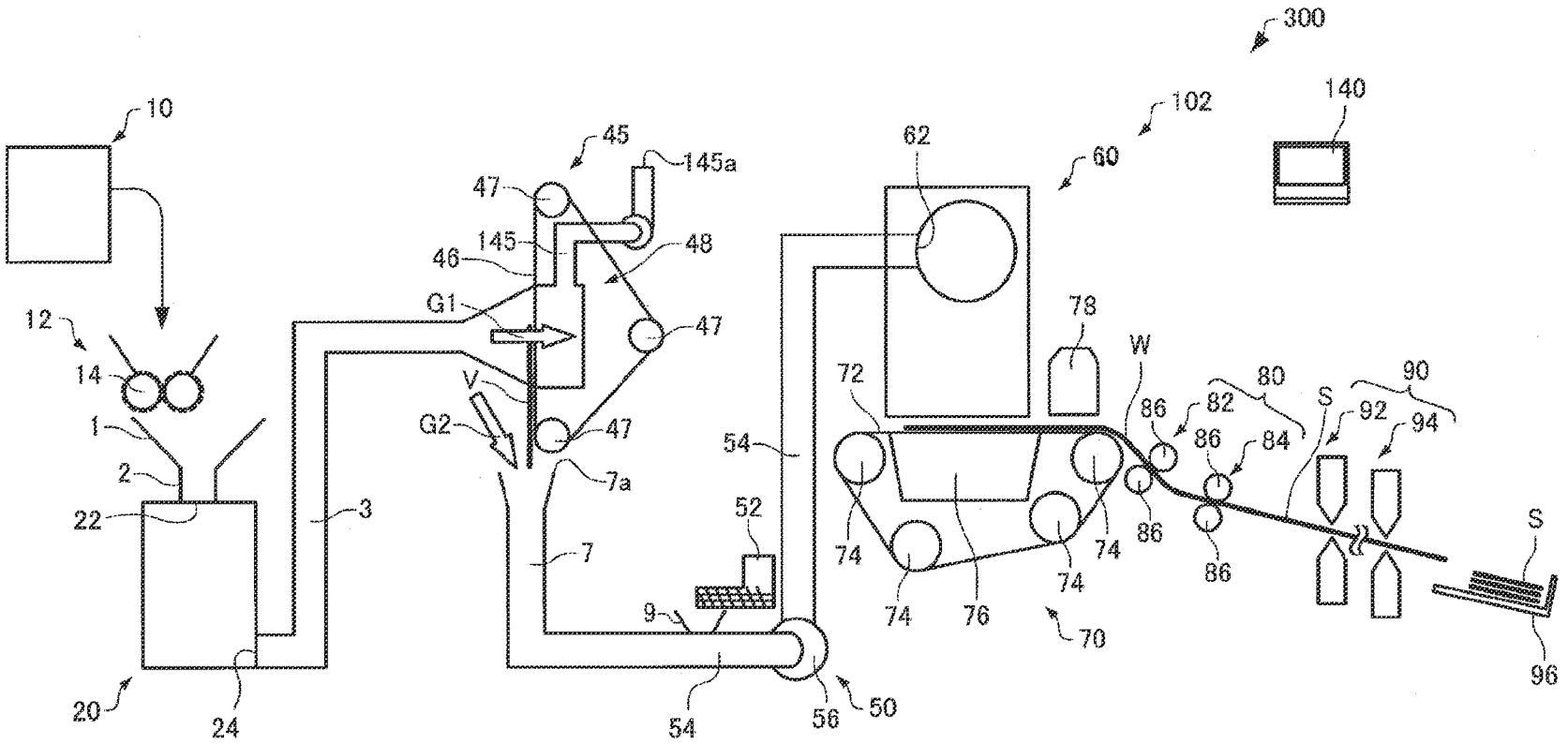
FIG. 3 illustrates a sheet manufacturing apparatus according to a second variation of the foregoing embodiment of the invention.

A sheet manufacturing apparatus according to a second variation of the foregoing embodiment is described next with reference to the figures. FIG. 3 illustrates a sheet manufacturing apparatus 300 according to a second variation of the foregoing embodiment of the invention. Note that parts of the sheet manufacturing apparatus 300 according to this second variation of the foregoing embodiment having the same function as parts of the sheet manufacturing apparatus 100 according to the embodiment described above are identified by like reference numerals, and further description thereof is omitted below.

As shown in FIG. 1, defibrated material that passes the defibrating unit 20 in the sheet manufacturing apparatus 100 described above is conveyed through a conduit 3 to the separator 40.

As shown in FIG. 3, in this sheet manufacturing apparatus 300, defibrated material that passes the defibrating unit 20 is conveyed through the conduit 3 to the first web forming unit 45. This sheet manufacturing apparatus 300 does not have a separator 40. In the example shown in the figure, defibrated material that passes the defibrating unit 20 is captured by a mesh belt 46 that moves vertically (in the direction of gravity), moves with the mesh belt 46 (is conveyed by the mesh belt 46), and is introduced to the opening 7*a*.

Note that by appropriately setting the air flow of the gas G1 and the open area of the conduit 3, the wind speed when passing through the mesh belt 46 can be reduced, and the defibrated material captured by the mesh belt 46 can be made to move vertically (descend) by its own weight. In this configuration, the mesh belt 46 may be stationary, and a mechanism for rotationally driving the mesh belt 46 is not needed.

Furthermore, while not shown in the figures, the sheet manufacturing apparatus 300 may be configured with a wetting unit 147 as shown in FIG. 1 and FIG. 2.

The sheet manufacturing apparatus 300 also does not have a separator 40, and its size can be reduced accordingly.

Note that a sheet S manufactured by the sheet manufacturing apparatus according to this embodiment refers primarily to a medium formed in a sheet. The invention is not limited to making sheets, however, and may produce board and web forms. Sheets as used herein include paper and nonwoven cloth. Paper includes products manufactured as thin sheets from pulp or recovered paper as the feedstock, and includes recording paper for handwriting or printing, wall paper, wrapping paper, construction paper, drawing paper, and bristol. Nonwoven cloth may be thicker than paper and low strength, and includes common nonwoven cloth, fiber board, tissue paper (tissue paper for cleaning), kitchen paper, vacuum filter bags, filters, fluid (waste ink, oil) absorbers, sound absorbers, cushioning materials, and mats. The feedstock may include cellulose and other plant fiber, PET (polyethylene terephthalate), polyester, and other types synthetic fiber, wool, silk, and other types of animal fiber.

The invention may be configured to omit some of the configurations described above insofar as the features and effects described above are retained, and may combine aspects of different embodiments and examples. Note that as long as it can manufacture sheets, the manufacturing unit 102 may be modified by omitting some configurations, adding other configurations, and substituting configurations known from the related art.

The invention includes configurations (such as configurations having the same function, method, and result, or configurations having the same purpose and effect) having effectively the same configuration as those described above. The invention also includes configurations that replace parts that are not essential to the configuration described in the foregoing embodiment. Furthermore, the invention includes configurations having the same operating effect, or configurations that can achieve the same objective, as configurations described in the foregoing embodiment. Furthermore, the invention includes configurations that add technology known from the literature to configurations described in the foregoing embodiment.

The entire disclosure of Japanese Patent Application No: 2015-042113, filed Mar. 4, 2015 is expressly incorporated by reference herein.

The invention claimed is:

1. A sheet manufacturing apparatus comprising:

a defibrating unit that defibrates a feedstock containing fiber into a defibrated material;

a mesh that captures at least part of the defibrated material conveyed from the defibrating unit by a first gas, the mesh passing the first gas;

an opening in which the defibrated material captured by the mesh and a second gas are introduced; and a sheet forming unit that forms a sheet using the defibrated material introduced from the opening, wherein a temperature of the first gas is higher than a temperature of the second gas.

2. The sheet manufacturing apparatus described in claim 1, further comprising:

a discharge vent from which the first gas passing through the mesh is discharged.

3. The sheet manufacturing apparatus described in claim 1, further comprising:

a wetting unit that wets the defibrated material captured by the mesh.

4. The sheet manufacturing apparatus described in claim 3, wherein:

the wetting unit humidifies the second gas introduced from the opening.

5. The sheet manufacturing apparatus described in claim 1, wherein:

the mesh is a mesh belt that is driven rotationally.

6. The sheet manufacturing apparatus described in claim 1, further comprising:

a suction unit that suctions the first gas from a downstream side of the mesh in a gas flow direction of the first gas.

7. The sheet manufacturing apparatus described in claim 1, further comprising:

a separator that separates the defibrated material defibrated by the defibrating unit; and a laying unit that detangles and lays the defibrated material introduced from the opening, where the mesh captures at least part of the defibrated material separated by the separator; and the sheet forming unit forms the sheet based on the defibrated material detangled by the laying unit.

8. A sheet manufacturing method comprising:

defibrating a feedstock containing fiber into a defibrated material;

transporting the defibrated material by using a first gas;

separating at least part of the defibrated material;

introducing the separated defibrated material and a second gas into an opening; and forming a sheet using the defibrated material introduced from the opening, wherein a temperature of the first gas is higher than a temperature of the second gas.

* * * * *